US005372489A

United States Patent [19]

Matsuda et al.

[11] Patent Number: 5,372,489

[45] Date of Patent: Dec. 13, 1994

[54] TWO STAGE VANE TYPE COMPRESSOR

[75] Inventors: Mikio Matsuda; Mitsuo Inagaki; Hideaki Sasaya, all of Okazaki, Japan

[73] Assignee: Nippon Soken Inc., Nishio, Japan

[21] Appl. No.: 139,122

[22] Filed: Oct. 21, 1993

[30] Foreign Application Priority Data

Dec. 22, 1992 [JP] Japan ..... 4-342053

[51] Int. Cl.[5] ..... F01C 1/30

[52] U.S. Cl. ..... 418/13; 418/15; 417/250; 417/252

[58] Field of Search ..... 418/3, 13, 15; 417/250, 417/252, 253, 296

[56] References Cited

U.S. PATENT DOCUMENTS

| | | | |
|---|---|---|---|
| 3,081,936 | 3/1963 | Wessling | 418/13 |
| 3,438,570 | 4/1969 | Bode et al. | 418/13 |
| 4,838,772 | 6/1989 | LeBlanc | 418/13 |

FOREIGN PATENT DOCUMENTS

| | | | |
|---|---|---|---|
| 2232445 | 12/1990 | United Kingdom | 418/13 |
| 1361378 | 12/1987 | U.S.S.R. | 418/13 |

OTHER PUBLICATIONS

"High Vaccuum Pumping Equipment", B. D. Power, 1966, pp. 12 and 18.

Points for Air conditioner for an Automobile, May 20, 1989, see the attached concise Explanation of Relevancy.

*Primary Examiner*—Richard E. Gluck
*Assistant Examiner*—Charles G. Freay
*Attorney, Agent, or Firm*—Cushman, Darby & Cushman

[57] ABSTRACT

A vane compressor capable of obtaining a two stage compression. The compressor has a front and rear rotor 6a and 6b for defining, together with a cylinder bores 43 and 44, first and second operating chambers 39 and 40, respectively. A refrigerant from a first inlet opening 28 is sucked into the first operating chamber 39 by a rotation of the front rotor 6a for obtaining a first stage compression at the first chamber 39. The refrigerant is then introduced, via an intermediate pressure chamber 36, to the second operating chamber 40 for obtaining a second stage compression at the second chamber 40, which is discharged outwardly.

10 Claims, 7 Drawing Sheets 2
13
8
16
4
38
4-1
27
34
37
10b
12
III
47
36
11
II
9a
3
26
35
1
7
7-1
17
15
6
6a
6b
14
43
36
II
9b
48'
5-1
5
48
III
44
40
114
112
111
110

Fig. 4-(a)
0° (360°)
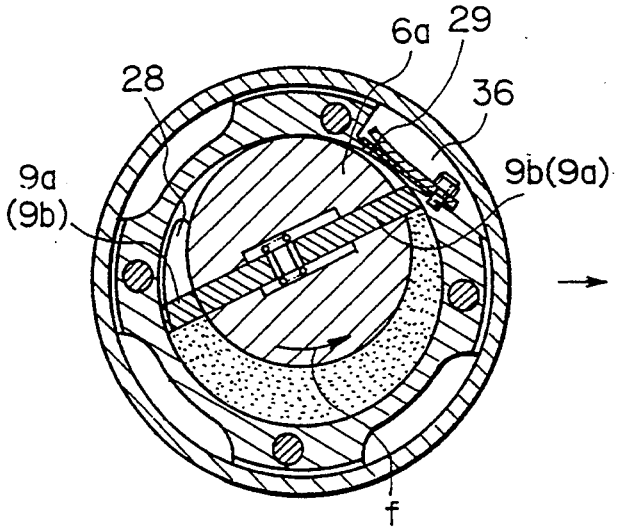
Fig. 4-(b)
90°
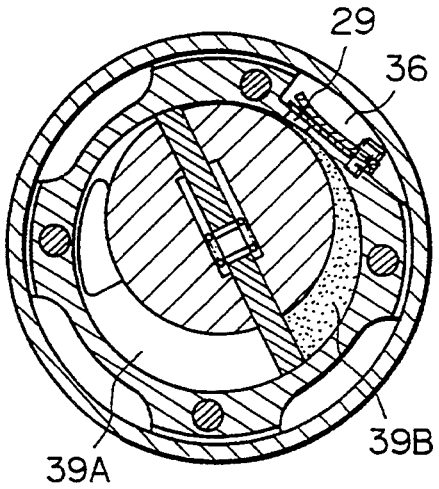
Fig. 4-(d)
270°
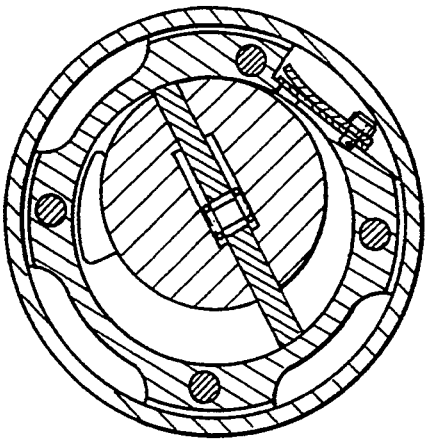
Fig. 4-(c)
180°
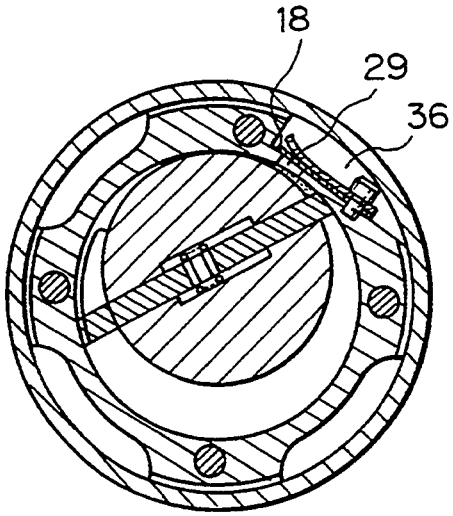

Fig. 5-(a)
0°(360°)
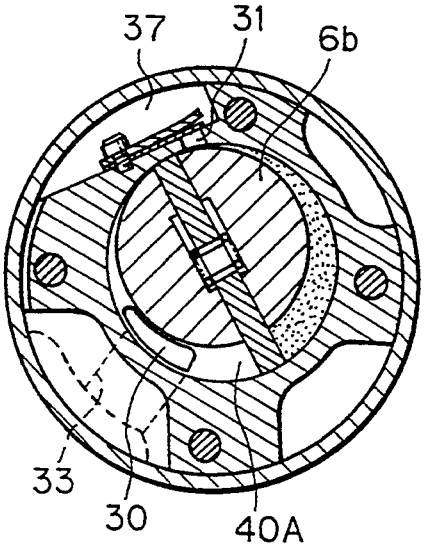
Fig. 5-(b)
90°
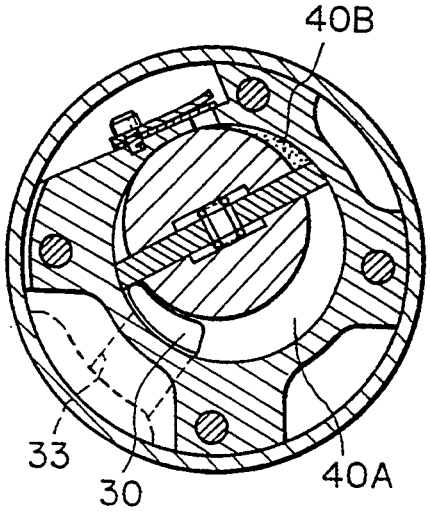
Fig. 5-(d)
270°
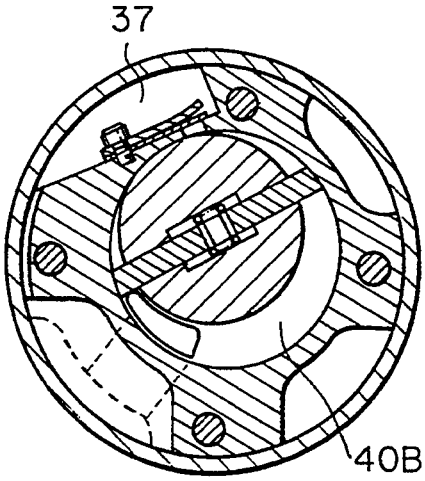
Fig. 5-(c)
180°
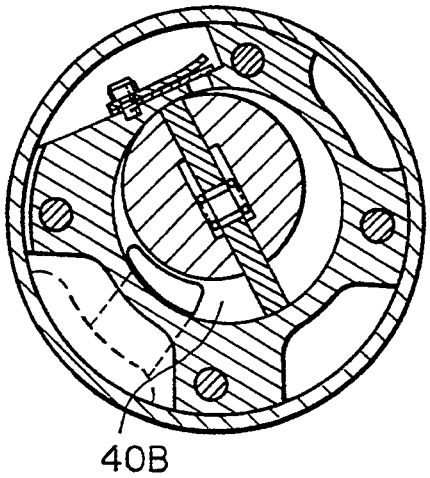

Fig. 6-(a)
PRIOR ART
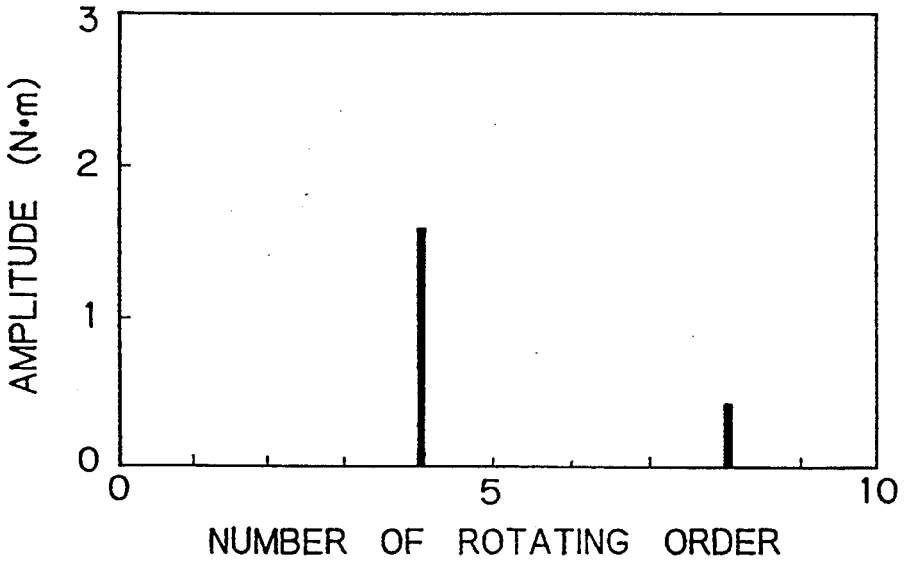
Fig. 6-(b)
PRESENT INVENTION
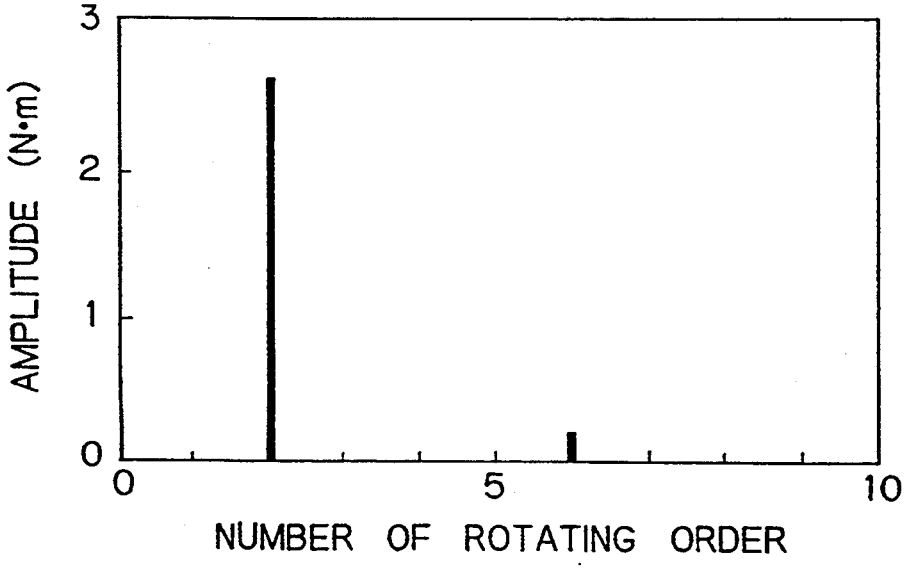

TWO STAGE VANE TYPE COMPRESSOR

BACKGROUND OF THE INVENTION

1. Field of the Invention

The present invention relates to a vane type compressor which is, in particular, used for compressing a refrigerant in an air conditioning system for an internal combustion engine.

2. Description of Related Art

Known in the prior art is a vane type multi-cylinder compressor of concentric rotor type, which has a cylinder of an elliptic cross sectional shape, in which a rotor of a pillar shape of a circular cross-section is arranged concentric, so that the rotor subjected to a rotational movement from an outside driving source is rotated while being contacted with an inner surface of the cylinder at its two locations. Also known in the prior art is a compressor of eccentric rotor type, which has a cylinder of a circular cross-sectional shape, in which a rotor of pillar shape of a circular cross-section is arranged eccentric, so that the rotor subjected to a rotational movement from an outside driving source is rotated while being contacted with an inner surface of the cylinder at its one location.

In both of the above compressors, a plurality of vanes are radially slidably inserted to the rotor, so that the vanes are urged by respective springs to contact with the inner surface of the cylinder, so that an operating chamber between the cylinder and the rotor is divided into a plurality of cylinder sections (working chambers). A number of sets of combinations of an inlet and an outlet port, corresponding to a half of the number of the cylinder sections, is provided. Namely, a pair of inlet and outlet ports is provided when the number of working cylinders is two, and, two pairs of inlet and outlet ports are provided when the number of the cylinder sections is four. During the rotating movement of the rotor while the vanes are radially reciprocated, the volume of the working chambers is varied, so that a working cycle is performed which consists of an admission period where an admission of a fluid medium is done from the inlet port to a working chamber of which the volume is increasing, a compression period where the fluid medium in the working chamber is subjected to a compression when the volume of the working chamber is decreasing, and a discharge period where the fluid compressed at the compression chamber is discharged via the outlet port.

In the compressor of the conventional type, a number of working cycles, corresponding to the number of the compression chambers, is done for every complete rotation of the rotor. Namely, four working cycles are done during one rotation when the number of the compression chambers is four. As a result, in the variation in the driving torque of the rotor, a component related to the number of working chambers (a component of the 4th order in case of 4 working chambers) becomes high. As a result, a resonance in the refrigerant recirculating pipe line is obtained at a low rotational speed area, causing a noise to be easily generated.

A reduction of the number of the cylinder sections (working cheers) allows the resonance area for the pipe line to be reduced. However, the reduction of the number of the working chambers causes the variation in the driving torque to become large, causing the vibration of the compressor to increase. The increase in the vibration of the compressor causes the operating noise to become large, which makes the users feel uncomfortable on one hand, and the service life of the compressor to be reduced on the other hand.

SUMMARY OF THE INVENTION

An object of the present invention is to provide a two stage compression type compressor capable of reducing the variation in the driving torque.

According to the present invention, a vane type compressor is provided, comprising:

(a) a housing;

(b) a shaft rotatably supported by said housing and adapted for connection to an outside source for a rotational movement;

(c) a cylinder body arranged in the housing for defining first and second cylinder bores;

(d) first and second rotors rotatably connected to the shaft and arranged in the first and second cylinder bores, respectively so that said rotors rotate in the respective cylinder bores while the rotors contact the inner surfaces of the respective cylinder bores;

(e) a first operating chamber formed between an outer surface of the first rotor and an inner surface of the first cylinder;

(f) a second operating chamber formed between an outer surface of the second rotor and an inner surface of the second cylinder;

(g) a first vane arranged radially in the first rotor to be extended therefrom, so that the first operating chamber is divided into an intake section and an outlet section;

(h) a second vane arranged radially in the second rotor to be extended therefrom, so that the second operating chamber is divided into an intake section and an outlet section;

(i) an intake pressure chamber in the housing for allowing the fluid in the intake pressure chamber to be sucked into the intake section of the first operating chamber;

(j) an intermediate pressure chamber for allowing the fluid in the outlet section of the first operating chamber to be sucked into the intake section of the second operating chamber, and;

(k) an outlet pressure chamber for allowing the fluid in the outlet section of the second operating chamber to be forced into the outlet pressure chamber.

BRIEF DESCRIPTION OF ATTACHED DRAWINGS

FIGS. 4-(*a*) to (*d*) show various phases of operation of the first chamber during one rotation of the rotor.

FIGS. 5-(*a*) to (*d*) show various phases of operation of the second chamber during one rotation of the rotor.

FIG. 6-(*a*) is a relationship between a number of rotational order in a drive torque variation in the prior art compressor.

FIG. 6-(*b*) is a relationship between a number of rotational order in a drive torque variation in the compressor of the present invention.

Figure 2:
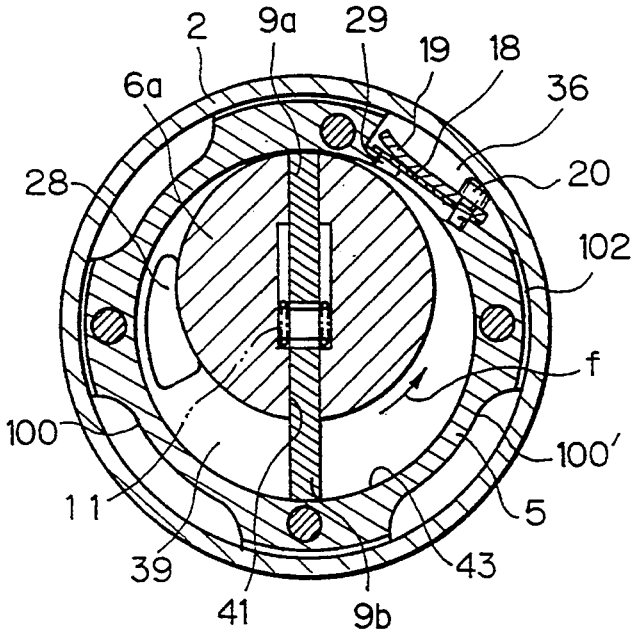
FIG. 2 is a transverse cross sectional view of the compressor according to the present invention, taken along line II—II in FIG. 1.
Figure 3:
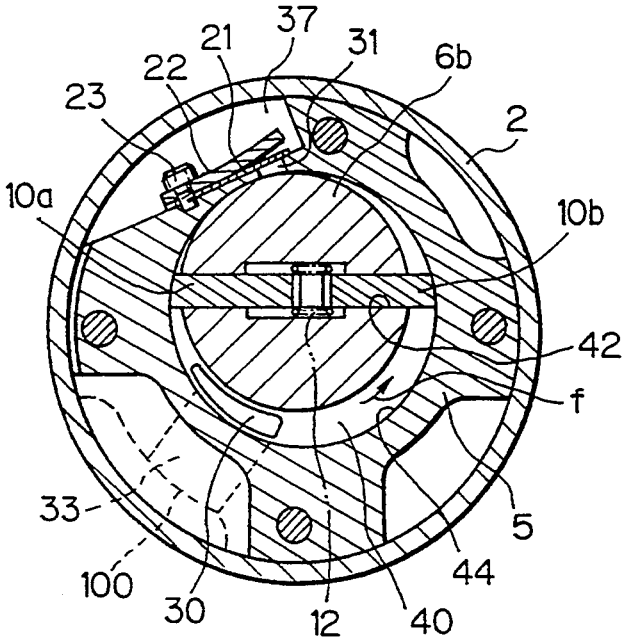
FIG. 3 is a transverse cross sectional view of the compressor according to the present invention, taken along line III—III in FIG. 1.
Figure 7:
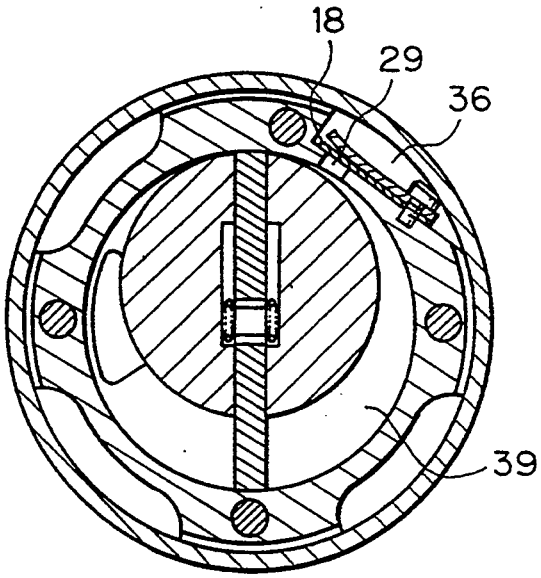
Figure 8:
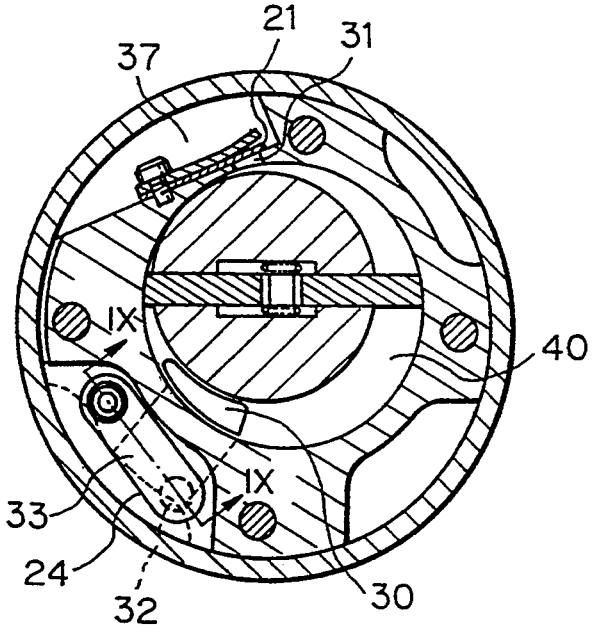

FIGS. 7 and 8 are similar to FIGS. 2 and 3, respectively, but in a second embodiment according to the present invention.

Figure 9:
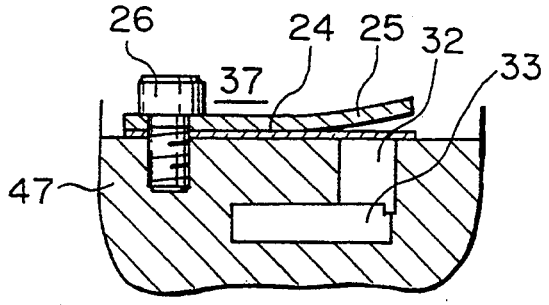

FIG. 9 is a view taken along line IX—IX in FIG. 8.

Figure 1:
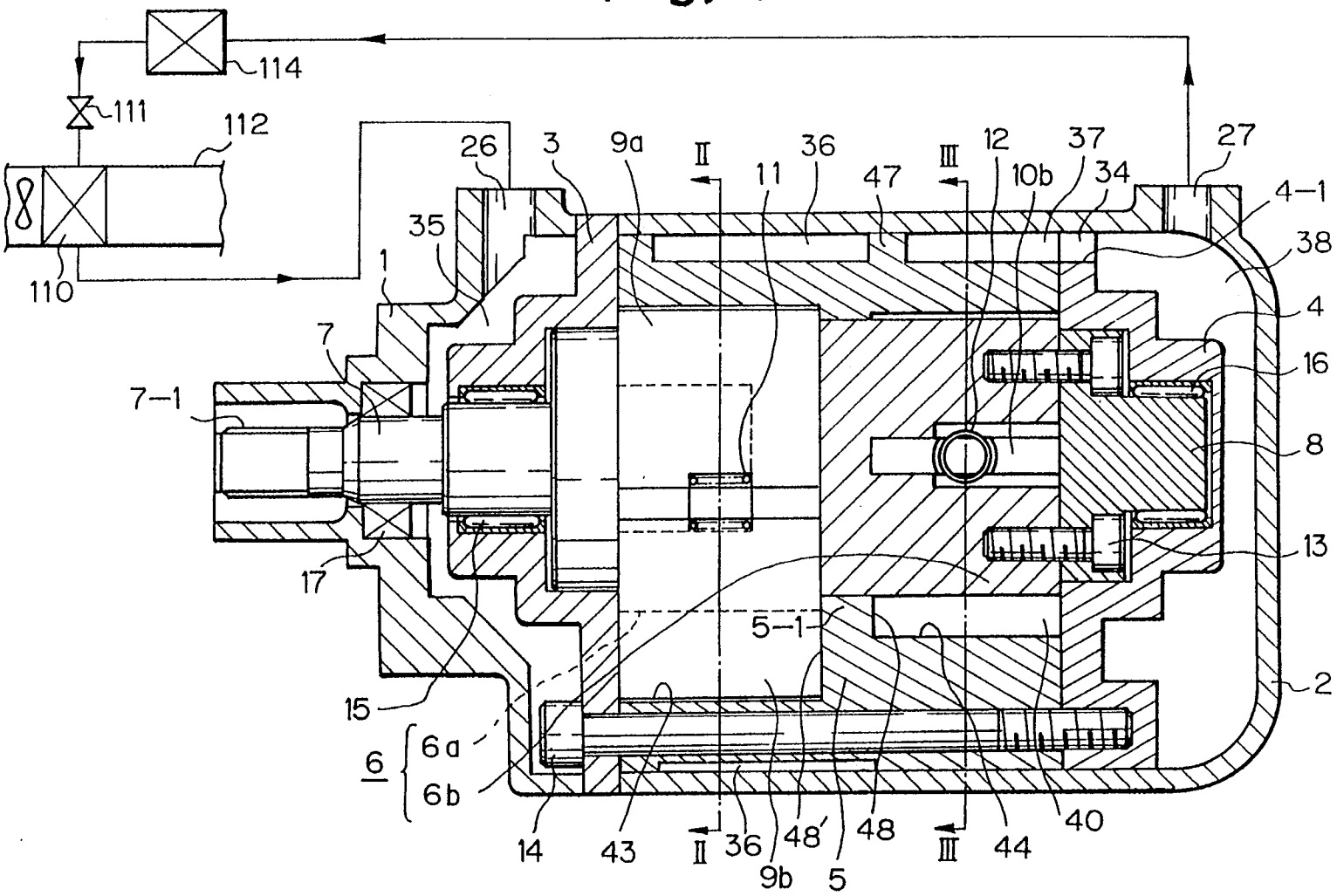
FIG. 1 is a longitudinal cross sectional view of a compressor according to the present invention.
Figure 10:
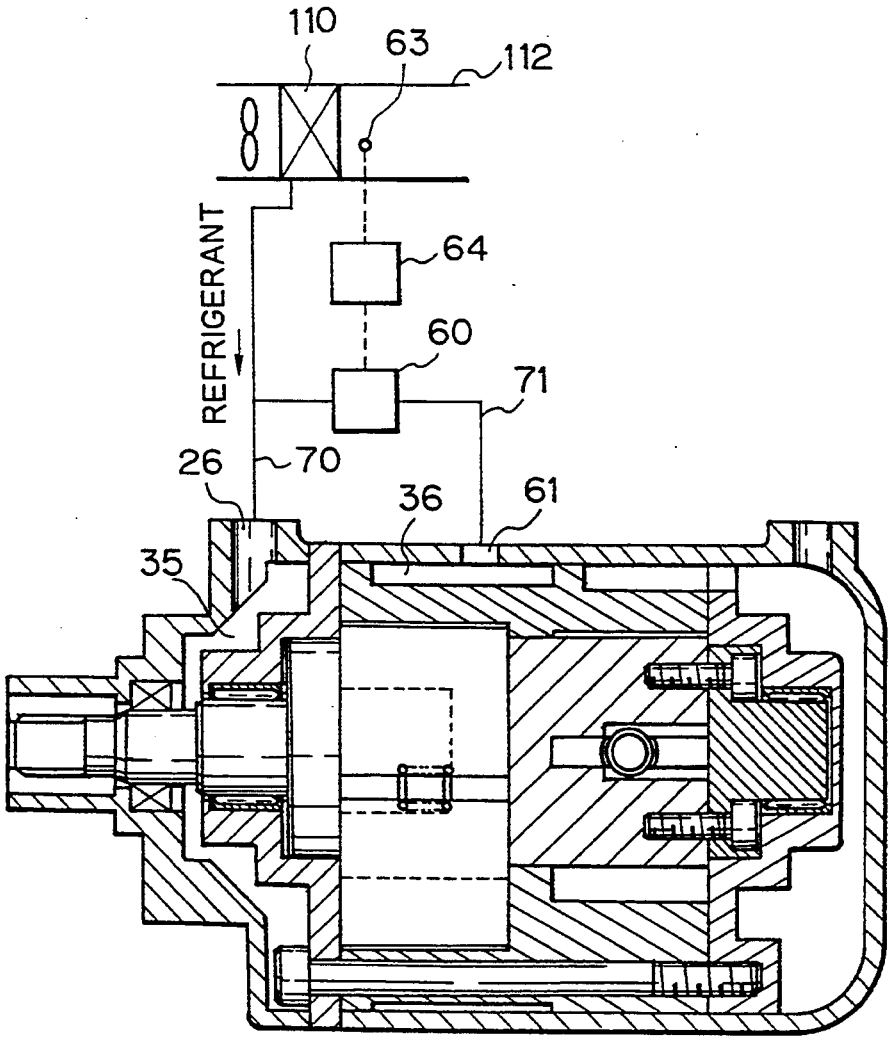

FIG. 10 is similar to FIG. 1 but shows a second embodiment.

DESCRIPTION OF PREFERRED EMBODIMENTS

In FIG. 1, showing an air conditioning apparatus for an automobile having a compressor according to the present invention, the compressor has a front side plate 3 defining a central bore to which a shaft 7 is rotatably supported by means of a needle bearing 15. The shaft 7 has one end defining a spline 7-1, to which a tubular shaft (not shown) of a clutch (not shown) is engaged. The clutch is connected to a crankshaft (not shown) of an internal combustion engine, so that the rotational movement of the engine is applied to the compressor when the clutch is engaged.

A reference numeral 6 denotes a rotor 6, which includes a front rotor portion 6*a* of circular pillar shape and a second rotor portion 6*b* of a circular pillar shape. The second rotor portion 6*b* is formed integral with the first rotor portion 6*a* so that these rotor portions 6*a* and 6*b* have the same axis of rotation. The second rotor portion 6*b* has a diameter slightly smaller than the diameter of the first rotor portion 6*a*. The first rotor portion 6*a* has an end spaced from the second rotor portion 6*b*, which end is connected to the front shaft 7 by means of bolts (not shown). An auxiliary shaft 8 is provided, which has an end spaced from the first rotor portion 6*a*, which end is connected to the auxiliary shaft 8 by means of bolts 13. The auxiliary shaft 8 is rotatably connected to a rear side plate 4 via a needle bearing 16. As a result, the rotational movement of the shaft 7 causes the rotor 6 to be rotated. It should be noted that the front rotor portion 6*a* may be formed integral with respect to the shaft 7. Contrary to this, the rear rotor portion 6*b* may be integral with respect to the auxiliary shaft 8.

A reference numeral 1 denotes a front housing having a central bore, through which the shaft 7 extends. A shaft seal assembly 17 is arranged between the front housing 1 and the shaft 7, so that a refrigerant and lubricant mixed therewith are prevented from being leaked outwardly from the compressor.

A cylinder 5 is provided for storing therein the rotor 6, and is arranged inwardly of a rear housing 2. The cylinder 5 is connected to the front side plate 3 and the rear side plate 4 by means of bolts (not shown). Bolts (not shown) are also provided for connecting the front side plate 3 to both the front housing 1 and rear housing 2. The cylinder member 5 is constructed by a first cylinder portion forming therein a first, front cylinder bore 43 and a second cylinder portion forming therein a second, rear cylinder bore 44. In the cylinder 5 is further formed, at its inner cylindrical wall, an annular partition wall 5-1 between the front and rear cylinder bores 43 and 44. The partition wall 5-1 has axially spaced apart parallel walls 48 and 48'. These cylinder bores 43 and 44, which are axially spaced, have the common longitudinal axis. The front rotor 6*a* is, as shown in FIG. 2, arranged eccentrically in the front cylinder bore 43, so that the front rotor 6*a* maintains its contact with an inner surface of the cylinder bore 43 while the front rotor 6*a* is rotated by the rotation of the shaft 7. Similarly, the front rotor 6*b* is, as shown in FIG. 3, arranged eccentrically in the rear cylinder bore 44, so that the front rotor 6*b* maintains its contact with an inner surface of the cylinder bore 44 while the front rotor 6*b* is rotated by the rotation of the shaft 7. Furthermore, the first rotor 6*a* is, at its rear end, contacted with the front surface 48' of the partition wall. AS shown in FIG. 2, a first operating chamber 39 is created between the inner surface of the cylinder bore 43 and the outer surface of the front rotor 6*a*. AS shown in FIG. 3, a second operating chamber 40 is created between the inner surface of the cylinder bore 44 and the outer surface of the rear rotor 6*b*.

As shown in FIG. 2, the first rotor 6*a* contains, along its the diameter, a slit 41, into which diametrically opposite vanes 9*a* and 9*b* of a plate shape are radially slidably inserted. A coil spring 11 is arranged between the vanes 9*a* and 9*b*, so that the spring 11 urges the vanes 9*a* and 9*b* radially outwardly, causing the vanes to be contacted with the inner peripheral surface of the cylinder bore 43. As shown in FIG. 3, the second rotor 6*b* forms, along its the diameter, a slit 42, which extends in a direction which is 90 degree with respect to the direction in which the slit 41 in the first rotor 6*a* extends. Into the slit 42, radially opposite vanes 10*a* and 10*b* of plate shape are radially slidably inserted. A coil spring 12 is arranged between the vanes 10*a* and 10*b*, so that the spring 12 urges the vanes 10*a* and 10*b* radially outwardly, causing the vanes to be contacted with the inner peripheral surface of the cylinder bore 44.

During the rotation of the rotor 6*a* in the cylinder bore 43, the vanes 9*a* and 9*b* move radially in the slits 41, so that the vanes 9*a* and 9*b* divide the operating chambers 39 into sections 39A and 39B in FIG. 4, the volume of which changes continuously as the rotor 6*a* rotates. Similarly, during the rotation of the rotors 6*b* in the cylinder bore 44, the vanes 10*a* and 10*b* move radially in the slits 42, so that the vanes 10*a* and 10*b* divide the operating chambers 40 into sections 40A and 40B in FIG. 5, the volume of which changes as the rotor 6*b* rotates.

As shown in FIG. 1, the front housing 1 is formed with an inlet port 26, which is opened to an inlet chamber 35 formed between the front housing 1 and the front side plate 3. The inlet port 26 is connected to an evaporator 110 in an refrigerating circuit which is arranged in a air conditioning duct 112, so that a gaseous state refrigerant from the evaporator is introduced, via the inlet port 26, to the inlet chamber 35. The front side plate 3 is, as shown in FIG. 2, formed with a first inlet opening 28 which is opened to the operating chamber 39 on an inlet section of the operating chamber 39, when the volume of the section is increased as the rotor 6*a* rotates as shown by an arrow f in FIG. 2, so that the refrigerant from the inlet chamber 35 is sucked, via the inlet opening 28, into the operating chamber 39. As shown in FIGS. 1 and 2, an intermediate pressure chamber 36 is formed between the rear housing 2 and the cylinder member 5. The cylinder member 5 is formed with an outlet opening 29, which is opened to the intermediate pressure chamber 36 via a first outlet valve 18. The outlet opening 29 is opened to an outlet section of the operating chamber 39, when a volume of the section is decreased as the rotor 6*a* rotates, so that the refrigerant from the operating chamber 39 is discharged, via the outlet opening 29 and the outlet valve 18, to the intermediate pressure cheer 36. The first outlet valve 18 is formed as a reed valve, which is at its one end connected to the housing member 5 by means of a bolt 20 together with a first stopper plate 19.

A second inlet opening 30 is formed in the annular partition wall 5-1 and is opened to the second operating chamber 40 on a section of the operating chamber 40, when the volume of the section is increased as the rotor **6*b* rotates as shown by an arrow f in FIG. 2, so that the refrigerant from the inlet opening 30 is introduced into the second operating chamber 40. As shown in FIGS. 1 and 2, a first outlet pressure chamber 37 is formed between the cylinder 5 and the housing 2. A second outlet opening 31 is formed in the cylinder 5. The second outlet opening 31 is opened to a section of the second operating chamber 40, when a volume of the section is decreased as the rotor 6*b* rotates, so that the refrigerant from the second operating chamber 40 is discharged, via the outlet opening 31 and a second outlet valve 21, to the first outlet pressure chamber 37. The second outlet valve 21 is formed as a reed valve, which is at its one end connected to the housing member 5 by means of a bolt 23 together with a second stopper plate 22. The arrangement of the second operating chamber 40 is such that a phase difference of 90° exists with respect to the first inlet opening 28 and the second inlet opening 30, so that, comparing a timing for the commencement of the compression stroke at the first chamber 39**, a timing for the commencement of the compression stroke is advanced by an angle of 45°.

As shown in FIG. 2, the cylinder 5 has, at its outer surfaces, circumferentially spaced recesses 100 and 100', which are in communication with the intermediate chamber 36 via spaces 102 which are formed between the housing 2 and the cylinder 5. As shown in FIG. 3, the cylinder 5 forms a passageway 33, which connects the recess 100 with the second inlet opening 30. As a result, the intermediate pressure chamber 36 is connected, via the passageway 33, to the second operating chamber 40, so that the refrigerant from the first operating chamber 39 is introduced into the second operating chamber 40.

As shown in FIGS. 2 and 3 the first outlet pressure chamber 37 is created between the housing 2 and the cylinder 5, and the chamber 37 is closed off from the intermediate chamber 36 by means of a circumferentially extending radial projection 47. In the chamber 37, the second outlet valve 21 is arranged for preventing the refrigerating medium from moving back into the second operating chamber 40.

The rear side plate 4 is formed with a recess 4-1 at its outer edge 4-1, so that a Communication passageway 34 is formed between the housing 2 and the rear side plate 4. A second outlet chamber 38 is formed between the housing 2 and the plate 4, which chamber communication the first outlet chamber 37 via the passageway 34. The housing 2 forms an outlet port 27, which is for a connection of the second outlet chamber 38 with a condenser 114 in the refrigerating circuit, which is connected to the evaporator 110 via an expansion valve 111.

Now, an operation Of the first embodiment will be described with reference to FIGS. 4 and 5. FIG. 4 shows, during one complete rotation of the shaft 7, an operation of the first chamber 39 at various timings corresponding to a position (a) of 0° rotation, a position (b) of 90° rotation, a position (c) of 180° rotation and a position (d) of 270° rotation. FIG. 5 shows an operation of the second operating chamber at timings corresponding to those in FIG. 4. In FIG. 4(*a*), during the rotation of the shaft 7 (rotor **6*a*) as shown by an arrow f, the chamber sections 39B is disconnected from both of the first intake port 28 and the first outlet opening 29. The volume of the chamber section 39B at this position (a) corresponds to an intake amount of the compressor. Furthermore, the vanes 9 and 10 divide the first and second operating chambers 39 and 40 into two sections 39A and 39B and 40A and 40B, respectively. In other words, a two cylinder section construction is obtained both for the first and second chambers 39 and 40**.

The rotation of the rotor 6 in the direction as shown by the arrow f from positions (a) to (b) causes the volume of the chamber section 39B to be gradually reduced, thereby compressing the refrigerant in the chamber section 39B. As a result, the refrigerant in the outlet section 39B is discharged to the intermediate cheer 36 via the first outlet opening 29, and then, introduced into the inlet section 40A via the passageway 33 and the second inlet opening 30. When the rotor 6 is rotated for an angle of 315°, which is located between the position (d) and (a) in FIG. 5, the intake stroke at the second chamber 40 is completed, and then a gradual reduction in the volume of the outlet section 40B of the second chamber is commenced, so that the refrigerant at the second chamber 40 is subjected to an additional compression, causing the second outlet valve 21 to be opened when the pressure reaches a refrigerant pressure which is suitable at the condenser 114 for the refrigerant cycle, causing the refrigerant to be discharged into the first outlet chamber 37 via the second outlet opening 31.

In FIG. 4(*a*), the second section 39B of the first chamber 39 is shown filled by the medium. The rotation of the rotor section **6*a* from the 0° position (a) to the 90° position (b) causes the medium at the section 39B to be compressed. During the rotation from the 90° position (b) to the 180° position (c), the pressure of the medium in the section 39B causes the first outer valve 18 to be opened, causing the medium to be discharged into the intermediate pressure chamber 36 via the first outlet. The medium in the intermediate chamber 36 is, during the rotation of the rotor section 6*b* from the 180° position (c) in FIG. 5 to the 270° position (d), introduced into the chamber section 40B of the second chamber. The medium in the section 40B is discharged into the outlet chamber 37 via the second outlet opening 31**.

As explained above, according to the present invention, the fluid medium (refrigerant) is subjected to the compression during the two rotations of the rotor 6, i.e., the shaft 7, so that the compression takes place more gradually than that in a compressor in a prior art where a complete one compression stroke occurs during a single rotation of a rotor. Furthermore, according to the present invention, two stage confession are done by the different compression chambers 39 and 40 to obtain a preset compression ratio, which allows the compression ratios at the respective chamber to become small, thereby allowing the torque variation to be reduced.

In a rotational order analysis of a driving torque variation of a compressor, a component of the variation having a frequency of 360 degree (one rotation of a rotor) is referred to as a rotational first order component. A component of the variation having a frequency of 180 degree (½ rotation of a rotor) is called a rotational second order component. Generally, a component of the variation having a frequency of 360/N degree (1/N rotation of a rotor) is referred as a rotational, Nth order component. Therefore, the prior art vane type compressor of four cylinder sections with one stage compression has a component of a driving torque variation of a rotational, 4th order which has a frequency equal to 90 degree (¼ rotation of a rotor). This torque variation can be decreased if another torque variation is applied, which has a torque variation having a difference of phase of a half of the frequency, which is equal to 45 degree.

According to the embodiment of the present invention, the compressor is a type having two cylinder sections with two stage compression. According to the embodiment, the relationship of the vanes 9*a* and 9*b*, and 10*a* and 10*b* with respect to the first and second inlet openings 28 and 30, respectively are such that, with respect to the first chamber 39, the second chamber 40 has a timing for a commencement of the compression operation which is advanced for a 45 degree. As a result, the rotational, 4th order component in the driving torque variation can be reduced, which would otherwise cause a operating noise to be increased due to the fact that the component is within an area of resonance in a pipe line for the refrigerant during a low rotational speed condition in a conventional compressor with 4 cylinder sections.

In FIG. 6-(*a*), the abscissa is the rotational order component in the driving torque variation while the ordinate is the amplitude of the torque variation in a prior art vane type compressor with four cylinder sections. FIG. 6-(*b*) is similar to FIG. 6-(*a*) but for the compressor in the first mentioned embodiment of the present invention. The results in FIGS. 6-(*a*) and (*b*) were obtained under an operating condition that the pressure $P_s$ of the refrigerant introduced into the intake chamber 35 is 2 kg/cm$^2$×G and the pressure $P_d$ of the discharged into the first outlet chamber 37 is 15 kg/cm$^2$×G.

The variation in the driving torque generates a rotating force in the shaft 7 of the compressor which causes it to be subjected to an oscillation having a rotating order number as shown in FIG. 6-(*a*). In the prior art compressor having four cylinder sections with single compression, as shown in FIG. 6-(*a*), the torque variation has a rotational, fourth order component of a value of 1.6 N×m. The torque variation also has a rotational, 8th order component of a value of 0.4 N×m, which is, however, smaller than that of the fourth order component. Thus, the compressor is subjected to a vibration having a frequency component of the 4th order, causing the operating noise to be distinct due to the fact that this component is located in a resonance area of the refrigerant recirculating pipe line during a low rotational speed condition.

Contrary to this, according to the present invention, as shown in FIG. 6-(*b*), the major component in the torque variation is shift to a rotating, second order one, and the fourth order component which is closely related to the operating noise is reduced only to a value of 0.2 N×m. The second order component does not substantially cause the noise to be increased, due to the fact that the frequency is small.

In the above embodiment, the construction is such that the rotating, 4th order component in the drive torque variation is reduced. However, a construction my be employed where a component of any number of order in rotation can be reduced. Namely, a phase difference of a half of a wave length in rotating, Nth order component in the driving torque variation is sufficient to reduce the amplitude of the variation. In other words, the first and second operating chambers must have a difference of timing for commencement of the compressor which is equal to 360/(2×N).

Furthermore, a suitable selection of a ratio of the volumes between the first and second than%hers 39 and 40 as well as the timing of the commencement of the compression allows the torque variation to be reduced over a wide range of pressures.

The above compressor that features two stage compression is executed by means of the provision of the first and second operating chambers 39 and 40. The pressure upon the first stage compression at the first chamber 39 (below, an intermediate pressure) is determined in accordance with the volume ratio between the first and second chambers 39 and 40. The value of the volume ratio is, therefore, determined such that a small value of the torque variation is obtained under a usual thermal load condition of the compressor. However, a very low thermal load condition causes a condensing pressure in the refrigerating cycle to become very small, which may cause the outlet pressure of the compressor to become smaller than a value of the intermediate pressure. In such a situation, the refrigerant, which is subjected to a super compressed condition at the first stage operating chamber 39, is subjected to an expansion at the second stage operating chamber 40, which causes the compressor driving power to be uselessly consumed.

In order to obviate this problem, a second embodiment shown in FIGS. 7 to 9, features that the partition wall 47 at the outer peripheral portion defines a by-pass passageway 32 which connects the communication passageway 33 opened to the second inlet openings 30 with the first outlet chamber 37. Furthermore, on a side of the partition wall 47 adjacent the first outlet cheer 37, an intermediate delivery valve 24, a reed valve, and a valve stopper plate 25 are provided. The intermediate delivery valve 24 together with the stopper plate 25 is, at its one end, connected to the partition wall 47 by means of the bolt 26. The intermediate delivery valve 24 is for preventing a reverse flow of the refrigerant from the outlet chamber 37 to the intermediate chamber 36.

As a result, according to the second embodiment, two kinds of passageways for the refrigerant subjected to the compression at the first chamber 39 are provided, these being a first passageway consisting of a first outlet opening 29, the first outlet valve 18, the intermediate pressure chamber 36, the passageway 33, the second inlet openings 30, the second chamber 40, the second outlet opening 31, the second outlet valve 21 and the first outlet chamber 37, and also a second passageway consisting of the first outlet opening 29, the first outlet valve 18, the intermediate pressure chamber 36, the passageway 33, the by-pass passageway 32, and the first outlet chamber 37.

In the operation of the second embodiment, two stage compression is done in a similar way as that in the first embodiment when the air conditioning load is in a usual area. Namely, the intermediate pressure at the intermediate pressure chamber 36 is equal to $$P_s^x \frac{1}{\alpha^K}$$

where $P_s$ is pressure of the refrigerant when it is introduced into the intake chamber 35, $\alpha$ is a ratio of volume between the first and second chambers 39 and 40, and K is the specific heat ratio. When, for example, $P_s$=2 kg f/cm$^2$ G, $\alpha$=0.47 and K=1.14, the intermediate pressure of 6.1 kg f/cm$^2$ is obtained. In such a usual thermal load condition, the outlet pressure is higher than the intermediate pressure, which causes the intermediate pressure valve 24 to close the by-pass passageway 32. As a result, the above mentioned first passageway is created, so that the two stage compression of the refrigerant at the first and second operating chambers 39 and 40 is obtained, thereby reducing the variation in the output torque.

In case where the thermal load is very small, the refrigerant pressure at the evaporator 110 (FIG. 1) is lowered in such a manner the outlet pressure at the compressor at the outlet chamber 38 is lower than the intermediate pressure at the intermediate pressure chamber 36. In such a situation, the two stage compression would generate a situation that the refrigerant subjected to a compression to the intermediate pressure at the first chamber 39 is subjected to an expansion to an outlet pressure at the second chamber 40, which would cause the driving power to be wasted. Contrary to this, according to the second embodiment, the outlet pressure lower than the intermediate pressure causes the intermediate pressure outlet valve 24 to open the by-pass passageway 32, which allows the second passageway to be created, which allows the refrigerant in the intermediate pressure chamber 36 to be directed into the by-pass passageway 32. As a result, the intermediate pressure at the chamber 36 and the outlet pressure at the outlet chamber 37 to be equalized, thereby preventing an occurrence of a super compression. Namely, the refrigerant is subjected to a compression at the first chamber to an outlet pressure, and then is discharged, via the first outlet opening 29, the intermediate pressure chamber 36, the passageway 33 and the by-pass passageway 32, to the first outlet chamber 37. In this case, the refrigerant in the intermediate pressure chamber 36 is sucked into the second operating chamber 40, so that the pressure at the second operating chamber 40 is equalized to the outlet pressure, thereby canceling the compression at the second operating chamber 40, thereby preventing a waste of the driving power. In this low load condition, only one stage compression is carried out, which does not cause the torque variation become to be large due to the small value of the compression.

FIG. 10 shows a third embodiment similar to the first embodiment, in which first and a second passageways 70 and 71 are created. The first passageway 70 is obtained when a control valve 60, which is operated by an electric control signal from an outside controller 64, is in its closed position, where the evaporated refrigerant from the evaporator 110 in the refrigerating cycle is introduced into the first operating chamber 39 via the intake port 26, the intake pressure chamber 35 and the first inlet opening 28. The second passageway is obtained when the control valve 60 is in its opened position, where the evaporated refrigerant from the evaporator 110 is introduced into the intermediate pressure chamber 36 via a intermediate inlet port 61. Arranged in the air conditioning duct 112 at a location downstream from the evaporator 110 is a sensor 63 for detecting the temperature of the air after being cooled by the evaporator 110 to generate an electric signal indicating the temperature of the air from the evaporator 110 into the control circuit During the operation of the third embodiment in FIG. 10, the closed position of the control valve 60 causes the first passageway 70 to be created, so that, similar to the first embodiment, the refrigerant is introduced into the first operating chamber 39 via the first inlet opening 28, so that the intake volume of the compressor is equal to the volume of the first chamber 39.

The opened position of the control valve 60 causes the refrigerant from the evaporator 62 to be introduced not only into the intake pressure chamber 35 via the first passageway 70 but also into the intermediate pressure chamber 36 via the second passageway 71. As a result, the intake pressure prevails both at the intake pressure chamber 35 and the intermediate pressure chamber 36, so that no compression operation is obtained at the first operating chamber 39, so that the intake volume of the compressor is equal to the volume of the second chamber 40.

In view of the above, the control valve 60 may be constructed as an electromagnetic valve, and a temperature sensor 63 is provided for a detection of the temperature of the air issuing from the evaporator 62. The controller 64 issues electric signals for opening or closing the valve 60 in accordance with the temperature of the air. Namely, when the temperature of the air issuing from the evaporator 62 is lower than a predetermined value (for example, 3° C.), the controller 64 issues a signal for energizing the electromagnetic valve 60 to open the passageway 71, resulting in a reduction in the intake volume of the compressor. As a result, the cooling ability by the evaporator 110 is reduced, so that the evaporator 110 is prevented from excessively cooled on one hand, and the power consumption of the compressor is reduced on the other hand. Contrary to this, when the temperature of the air issued from the evaporator 62 becomes higher than the predetermined value, the controller 64 issues a signal for de-energizing the electromagnetic valve 60 to close the passageway 71, resulting in an increase in the intake volume of the compressor. AS a result, the cooling ability by the evaporator 110 is increased to 100 percent. Such a two stage control of the of the ability of the compressor can prevent an occurrence of over cooling and a generation of ice.

In place of detection of the temperature of the air from the evaporator 110, the pressure of the refrigerant sucked can be detected. In this case, in place of the electrically operated valve 60, a purely mechanically operated relief valve can be employed. Namely, the valve includes a member, such as a diaphragm, which responds to the intake pressure of the refrigerant. Namely, when the pressure of the refrigerant becomes lower than a predetermined value (for example, 2 kg f/cm$^2$ G), the relief valve is moved to a closed position.

While the present invention is described with reference to the embodiments, many modifications and changes can be made by those skilled in this are without departing from the scope and spirit of the present invention.

We claim:

1. A vane type compressor, comprising:

(a) a housing:

(b) a shaft rotatably supported by said housing and adapted for connection with an outside source for a rotational movement.;

(c) a cylinder body arranged in the housing for defining first and second cylinder bores;

(d) first and second rotors connected to the shaft in rotation and arranged in the first and second cylinder bores, respectively, so that the rotors rotate in the respective cylinder bores while the rotors contact with inner surfaces of the respective cylinder bores;

(e) a first operating chamber formed between an outer surface of the first rotor and an inner surface of the first cylinder:

(f) a second operating chamber formed between an outer surface of the second rotor and an inner surface of the second cylinder;

(g) a first vane arranged radially in the first rotor to be extended therefrom, so that the first operating chamber is divided into an intake section and an outlet section;

(h) a second vane arranged radially in the second rotor to be extended therefrom, so that the second operating chamber is divided into an intake section and an outlet section;

(i) an intake pressure chamber in the housing for allowing the fluid in the intake pressure chamber to be sucked into the intake section of the first operating chamber;

(j) an intermediate pressure chamber for allowing the fluid in the outlet section of the first operating chamber to be sucked into the intake section of the second chamber; and (k) an outlet pressure chamber for allowing the fluid in the outlet section of the second operating chamber to be forced into the outlet pressure chamber, wherein timings for commencement of the compression in the first and second chambers, which are respectively determined by the phase difference between angular locations of the first and second vanes and by the phase difference between angular positions of the first and second inlet openings, are such that a particular rotating order component in a variation in driving torque of the shaft is reduced.

2. A compressor according to claim 1, wherein both of the first and second rotors form a circular pillar shape, while both of the first and second cylinder bores form a circular cylindrical shape, wherein the first and second cylinder bores are spaced along an axis which is parallel to the axis of the shaft, mid wherein the first operating chamber is formed between an outer cylindrical surface of the first rotor and an inner cylindrical surface of the first cylinder bore, while the second operating chamber is formed between an outer cylindrical surface of the second rotor and an inner cylindrical surface of the second cylinder bore.

3. A compressor according to claim 1, wherein said first or second vane comprises a pair of radially spaced, diametrically opposite first and second vane sections, and spring means for radially urging the first and second vane section so that the vane sections contact with the inner surface of the cylinder bores.

4. A compressor according to claim 1, wherein said first and second vanes are constructed and arranged to be circumferentially spaced so that a desired positional relationship is obtained between the first and second chamber upon rotation of said first and second rotors.

5. A compressor according to claim 1, wherein the first rotor and the second rotor are made from an integral body which has a pair of axially spaced first and second ends, the first end being connected to said shaft, and wherein an auxiliary shaft which is rotatable with respect to the housing is provided for connection with the second end of the rotor body.

6. A compressor according to claim 5, wherein said housing comprises: a front housing defining an inlet port for introduction of the fluid medium; a front side plate adjoining the front housing for rotatably supporting said shaft, the intake pressure chamber being formed between the front housing and the front side plate; a rear side plate for rotatably supporting the auxiliary shaft, and; a rear housing which, together with the rear side plate, forms the outlet pressure chamber, the rear housing defining an outlet port for discharging the compressed fluid from the outlet pressure chamber.

7. A compressor according to claim 6, wherein said front side plate defines a first inlet opening for introduction of the medium from the inlet pressure chamber to the inlet side of the first operating chamber, the cylinder body defines an outlet opening for discharging the fluid from the outlet section of the first operating chamber to the intermediate pressure chamber, the cylinder body has an inner annular projection which defines a second inlet opening for introduction of the fluid from the intermediate pressure chamber to the inlet section of the second operating chamber, and the cylinder body defines a second outlet opening for discharging the fluid from the outlet section of the second operating chamber to the outlet pressure chamber.

8. A compressor according to claim 1, further comprising a passageway connecting the intermediate pressure chamber and the outlet pressure chamber, and a check valve for obtaining one way communication of the fluid from the intermediate pressure chamber and the outlet pressure chamber.

9. A compressor according to claim 1, further comprising a passageway for connecting the inlet port of the housing and the intermediate pressure chamber, and a valve means, responsive to a control signal, for selectively opening the passageway.

10. A compressor according to claim 1, wherein the timings for commencement of the compression in the first and second chambers are determined so that the phase difference of 45 degree is obtained, thereby reducing a 4th rotating order component in a variation in driving torque of the shaft.

* * * * *